US008622226B2

(12) United States Patent
Colwell et al.

(10) Patent No.: US 8,622,226 B2
(45) Date of Patent: Jan. 7, 2014

(54) GUITAR CASE RACK

(76) Inventors: Dorothea M Colwell, Chicago, IL (US); Peter F Colwell, Manistique, MI (US)

( * ) Notice: Subject to any disclaimer, the term of this patent is extended or adjusted under 35 U.S.C. 154(b) by 0 days.

(21) Appl. No.: 13/370,382

(22) Filed: Feb. 10, 2012

(65) Prior Publication Data

US 2012/0138547 A1 Jun. 7, 2012

(51) Int. Cl.
*A47F 7/00* (2006.01)

(52) U.S. Cl.
USPC ..... 211/85.6

(58) Field of Classification Search
USPC ..... 211/85.6, 13.1, 85.7, 60.1, 67, 68, 64, 211/62, 39, 196, 205, 189; 248/150, 152, 248/165, 166, 528, 529; 84/327, 329
See application file for complete search history.

(56) References Cited

U.S. PATENT DOCUMENTS

| | | | | | |
|---|---|---|---|---|---|
| 4,352,480 | A * | 10/1982 | Gathright | 248/448 |
| 5,165,634 | A * | 11/1992 | Garbuzov et al. | 248/166 |
| 5,375,497 | A * | 12/1994 | Pirchio et al. | 84/327 |
| 5,505,413 | A * | 4/1996 | Hennessey | 248/166 |
| 5,664,756 | A * | 9/1997 | Liao | 248/443 |
| 5,927,514 | A * | 7/1999 | Linder | 211/26 |
| 5,959,225 | A * | 9/1999 | Hsu | 84/327 |
| 6,005,176 | A * | 12/1999 | Yu | 84/327 |
| 6,296,213 | B1 * | 10/2001 | Law et al. | 248/166 |
| 6,533,228 | B1 * | 3/2003 | Yu | 248/166 |
| 6,585,224 | B1 * | 7/2003 | Schmidt | 248/640 |
| 6,800,798 | B2 * | 10/2004 | Hsieh | 84/327 |
| 2002/0070319 | A1 * | 6/2002 | Yu | 248/122.1 |
| 2010/0122960 | A1 * | 5/2010 | Bliss | 211/64 |
| 2010/0181441 | A1 * | 7/2010 | Yu | 248/121 |

* cited by examiner

*Primary Examiner* — Darnell Jayne
*Assistant Examiner* — Hiwot Tefera

(57) ABSTRACT

This application is for guitar case rack or stand that can compactly hold a plurality of guitar cases, can roll, spin, or remain stationary. Case lids can be left open or closed, but the guitars remain substantially protected even with the lids left open. The case rack can transform into a dolly, and in this configuration, it stores extremely compactly.

7 Claims, 15 Drawing Sheets

GUITAR CASE RACK

BACKGROUND

1. Field of Invention

This patent application is for a guitar case storage rack or stand. It is novel because it is for cases and not directly for instruments and because it has a number of practical, new features. The invention provides a previously unheard of combination of security and access. The gold standard for guitar storage is "case-kept." In the past, "case-kept" also has meant inaccessible. However, the invention in this application provides for "case-kept" security while, at the same time, providing for really more accessibility than with instruments that hang on walls or rest on stands. First, the lids of the cases are held closed or open at the users will. Second, the case rack rolls, spins, and stays immobile at the will of the user. Third, the case rack transforms into a dolly to be used for such things as heavy amplifiers, monitors, mixing boards, and the like. Finally, the case rack adjusts to accommodate a wide range of cases.

2. Prior Art

Existing storage racks for guitars and similar instruments (for example, banjos, and bass guitars) hold instruments in a number of ways. For example, the instruments hang from their necks just below their headstocks or they rest on bottom edge of their lower bouts and lean their backs against the device at the upper bout, or they lean their necks against the device. In contrast to storing guitars, cases such as guitar cases and other similar instrument cases are generally stored in closets by rotating the case so that it rests against a closet wall. There are existing case racks that rely on rotating the cases. Alternatively, cases are tipped back to rest on a wall. This invention is related to tipping a case back to lean against one wall and rotating it clockwise at the same time to lean against another perpendicular wall as if in an inside corner. What will become clear is that this simple solution only replicates the attitude of a case held by the invention; it does not address all the problems that are solved by this invention. For example, the lid binds when trying to open it while the case is leaning back against one wall and rotated against a perpendicular wall. There are other problems like the relative insecurity of simply using the walls for support and the immobility of the arrangement.

The essential features of this invention are unprecedented in the market. This is a patent application for a case rack that simultaneously holds a case tipped backward and rotated to the right so that one case or a plurality of cases are held such that the lids of the cases are easily left closed or left open. When open, the guitars do not fall out. The ability to be held open or closed allows for very rapid access to a plurality, defined as one or more, of instruments while providing case-kept protection of the instrument or instruments when they are not in use. By arranging a plurality of cases around a central axis so that each tipped backwards and each is rotated to the right, the cases are held in a very compact group. This is in contrast to spreading cases out on a floor or a table or leaning them against a wall.

The case rack can be mobile which increases the access to instruments in addition to allowing the rack with cases to move from one place to another. It can spin around its central axis and roll in any direction. Spinning is particularly useful, because an instrumentalist can remain in one place, sitting or standing, and have rapid access to any of the cases on the rack by spinning the rack. In order to reduce the tendency for the case rack to roll inadvertently, the case rack can be made immobile.

In addition, the case rack folds and rolls in its folded configuration. As a result, it can be said that the case rack transforms into a dolly. In order to reduce the tendency for the dolly to roll inadvertently, it can be made immobile. The folding of the rack into the dolly configuration is accomplished by removing the cap from the rack and then folding the hinged struts into the shape of a cross. Finally, the cap is reattached below the folded supports. The fact that the case rack folds also means that the rack itself stores very compactly.

DESCRIPTION OF DRAWINGS

In FIG. 2, the cases are rotated twenty four degrees, 3, so that the lower bout of one case fits into the waist of the case to its left.

The overall shape of the case rack is pyramidal.

CONCLUSIONS, RAMIFICATIONS, AND SCOPE

Figure 1:
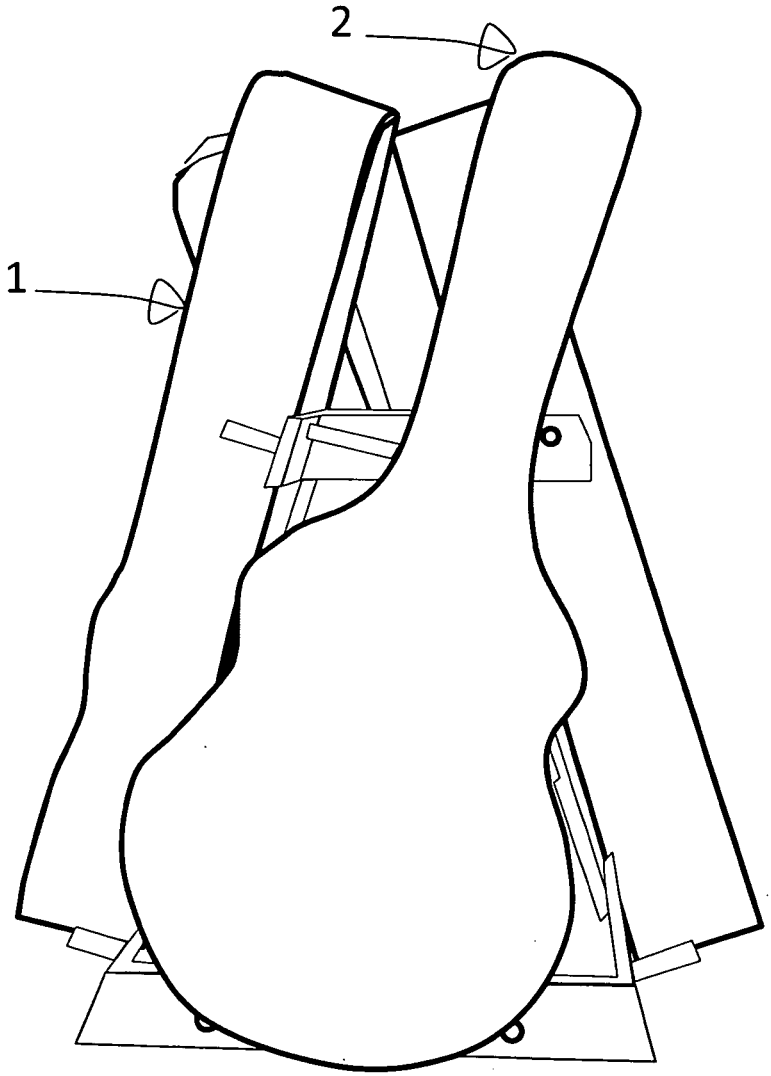
FIG. 1 illustrates multiple guitar cases being contained by the invention in this patent application, a guitar case rack or stand. This shows the cases being tipped back as indicated by arrow 1 and being rotated to the right, turned clockwise, as indicated by arrow 2. The upshot of a guitar case being tipped backward and simultaneously rotated to the right is that if the lid of a case is left open, it stays open, and a guitar in the case does not fall out of the case. In addition, if the lid is left closed, it stays closed even if it is not locked or latched.
Figure 2:
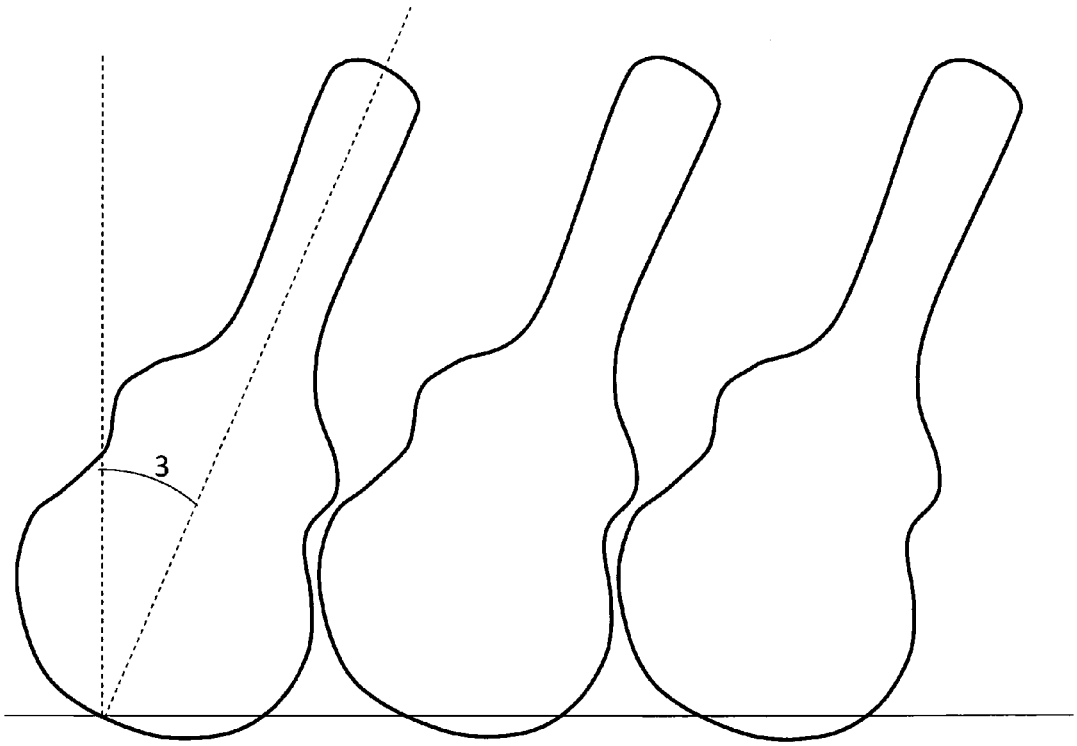
FIG. 2 shows that when there is a plurality of guitar cases in a row, it is useful to rotate the cases approximately twenty four degrees off of vertical to achieve maximum compactness.
Figure 3:
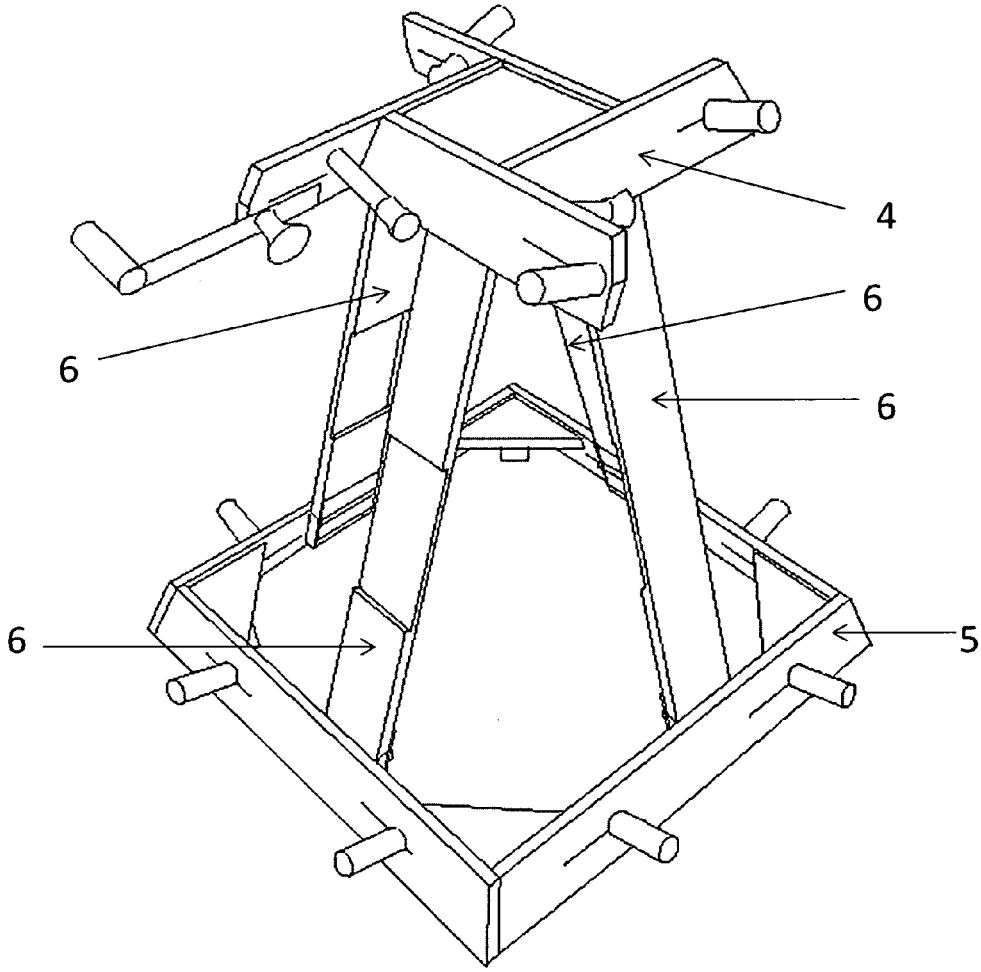
FIG. 3 shows the cap, 4, the base, 5, and the struts, 6. The sides of the pyramid are approximately 18 degrees off of vertical. So the sides are very steep. There is, of course, a trade-off that involves compactness and security regarding the tendency of guitars to stay in their cases. We find that 18 degrees provides ample security and remarkable compactness.
Figure 4:
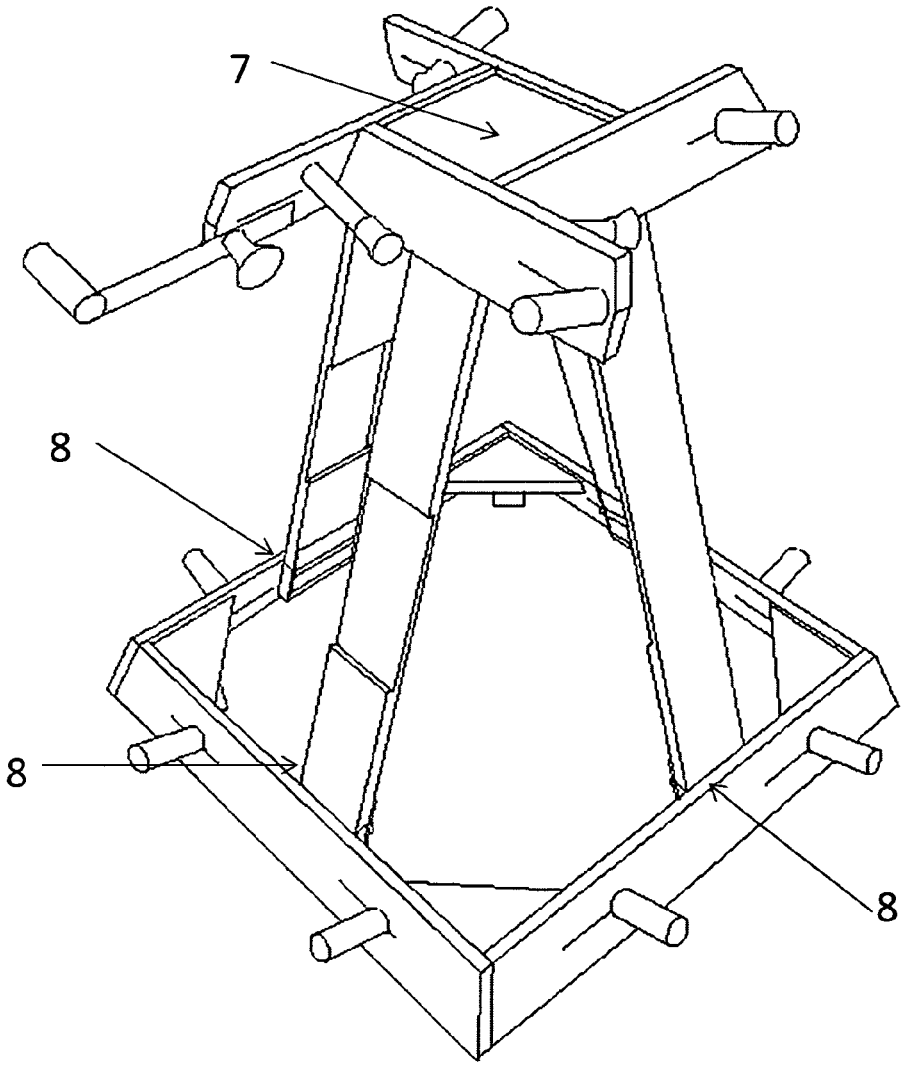
FIG. 4 shows the top of the cap and the setback of the struts. Number 7 shows the top of the cap which is surrounded by a lip intended to contain small objects such as guitar picks, tuners, capos and the like. Number 8 shows that the struts are set back from the base and cap sides. This setback allows the rack to accommodate cases with convex backs.
Figure 5:
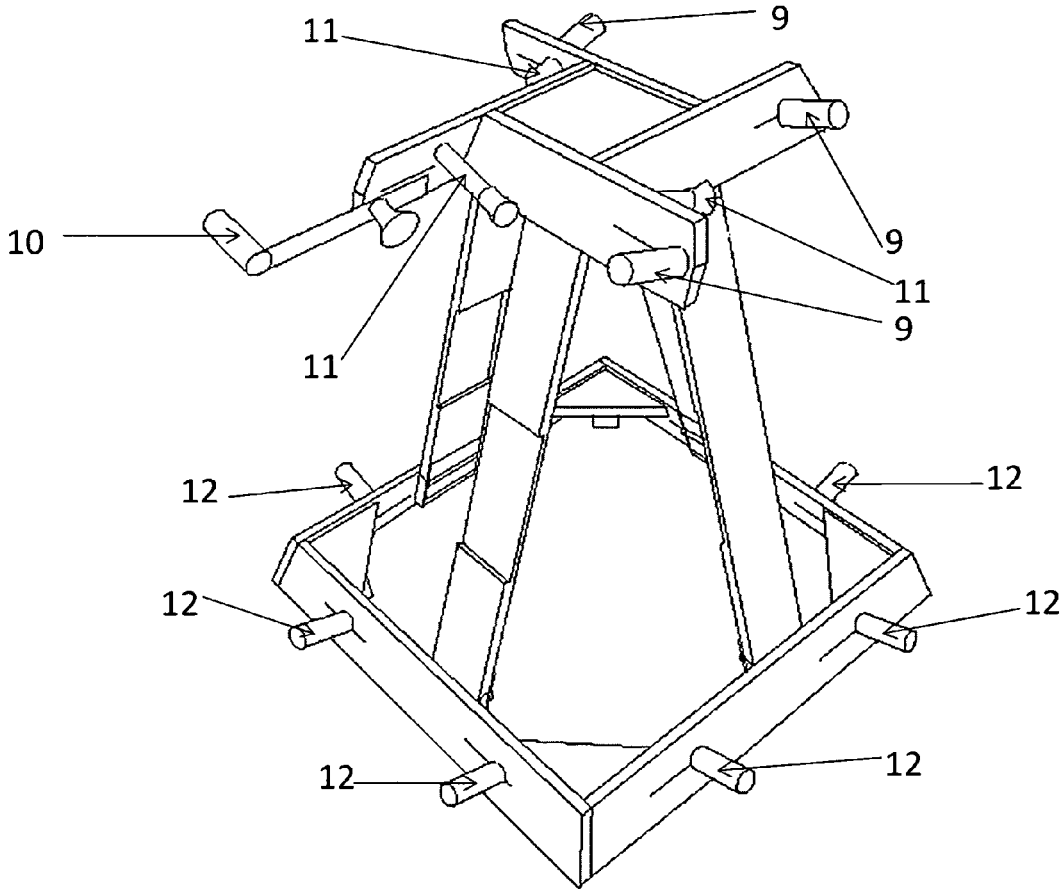
FIG. 5 shows the supports for the guitars. The number 9 shows the supports at the cap that are perpendicular to the sides of the cap. The number 10 shows a similar support on an extension that is used to accommodate rectangular cases. All these supports are dowels that are foam covered. The number 11 shows supports that are parallel to the sides of the cap but run perpendicular to the case necks. The end of the supports labeled 11 have a rubber covering that would be like a cane tip. Note that the supports labeled 11 are not all necessarily the same length. Length varies to accommodate differences in the width of cases. For example a short support is shown in the drawing on the side of the case rack that is meant to accommodate a rectangular case. The number 12 shows supports for the lower bout of guitar cases and are perpendicular to the sides of the base.
Figure 6:
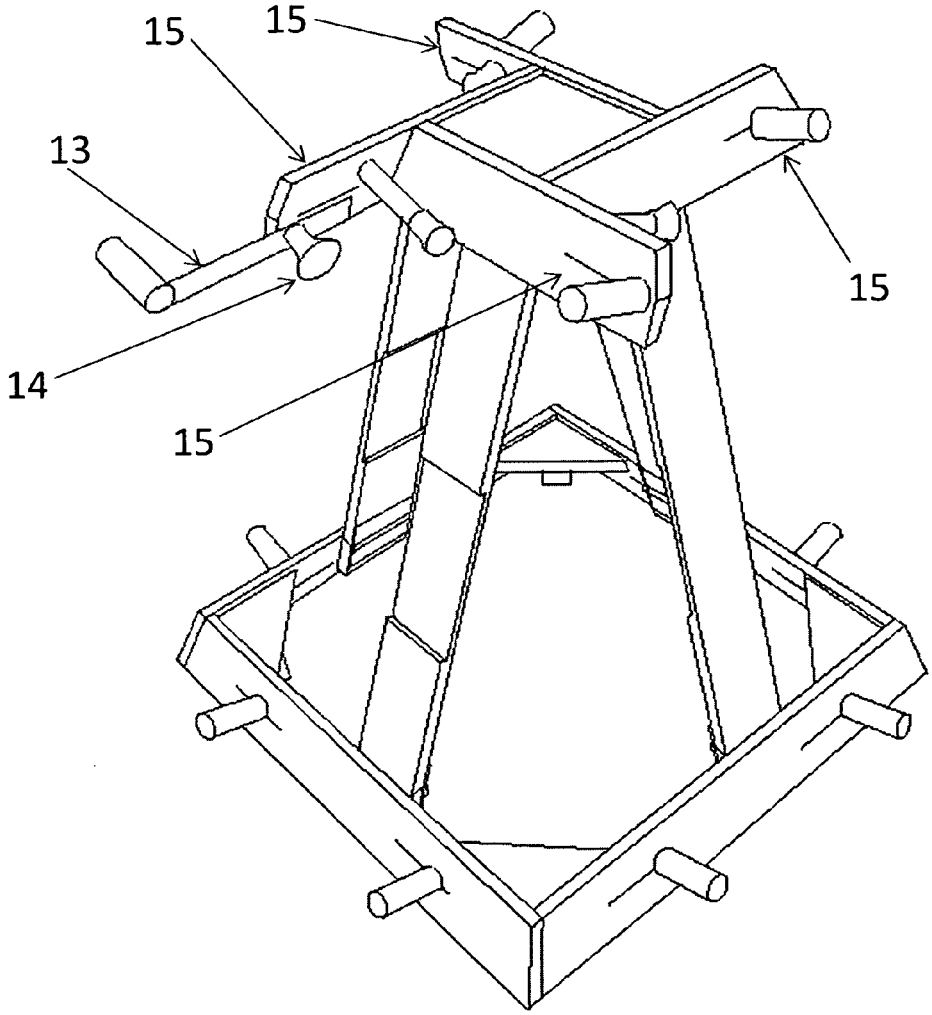
FIG. 6 shows, in part, how the case rack is adapted to rectangular cases. First, there is an extension of the arm on the cap shown as 13 in FIG. 6. Second, there is a knob with a bolt that holds the extension to the arm of the cap. This is 14 in FIG. 6. The arms for each side of the case rack are labeled 15 in FIG. 6.
Figure 7:
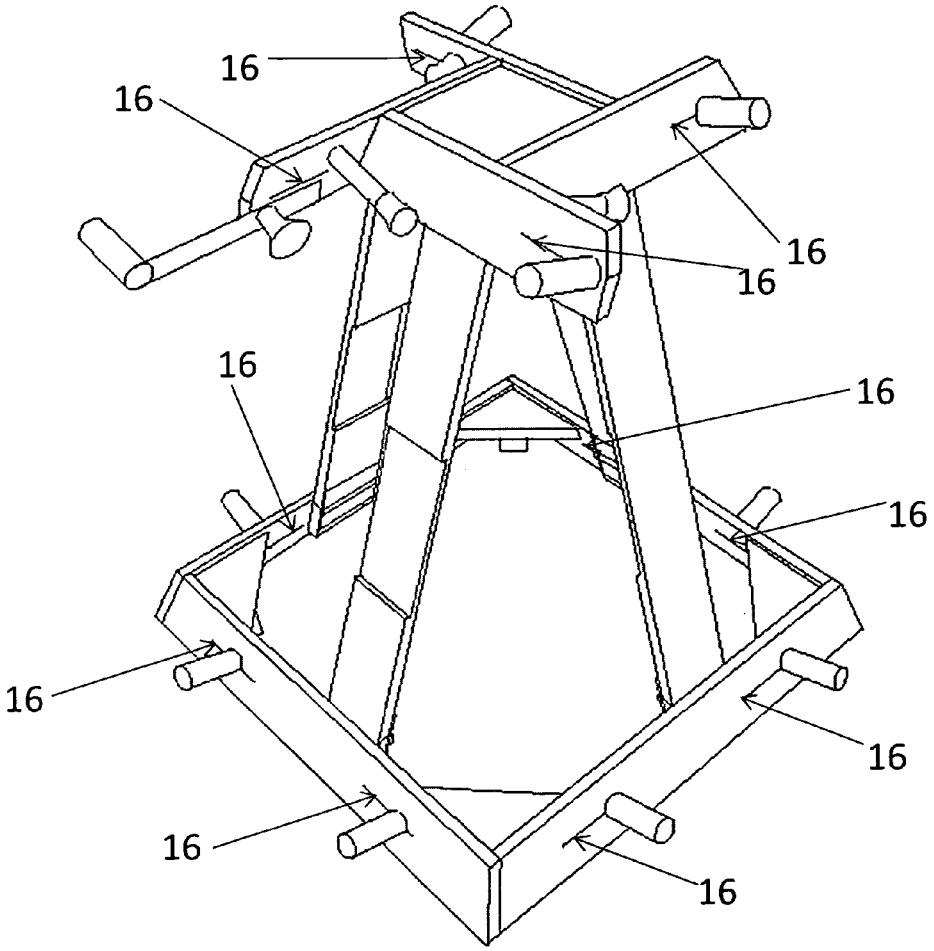
FIG. 7 shows the adjustment slots for the supports. The slots are labeled 16. These slots are horizontal. A wood screw goes through such a slot on the side of the cap or the base and goes into a support. A washer on the screw keeps the slot from being distorted by the head of the screw.
Figure 8:
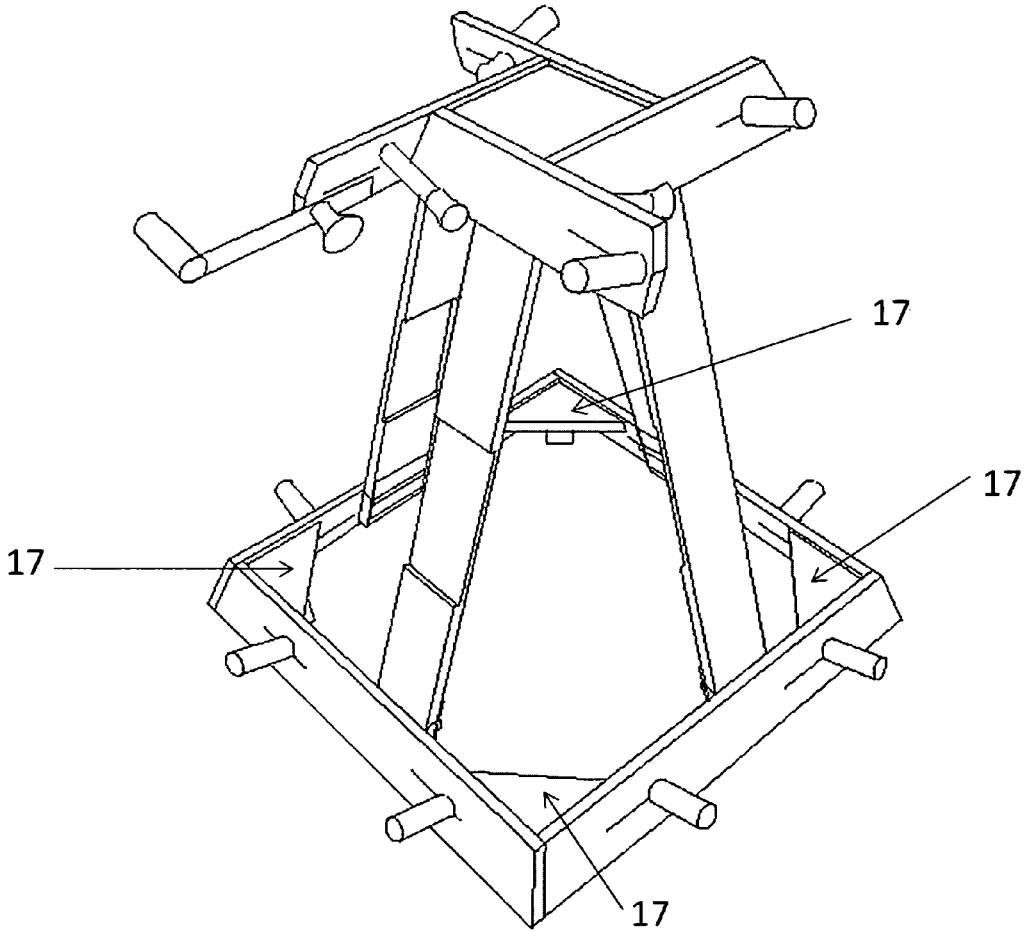
FIG. 8 shows the corner blocks for the base. These are indicated by the number 17. The corner blocks keep the base with 90 degree angles at the corners.
Figure 9:
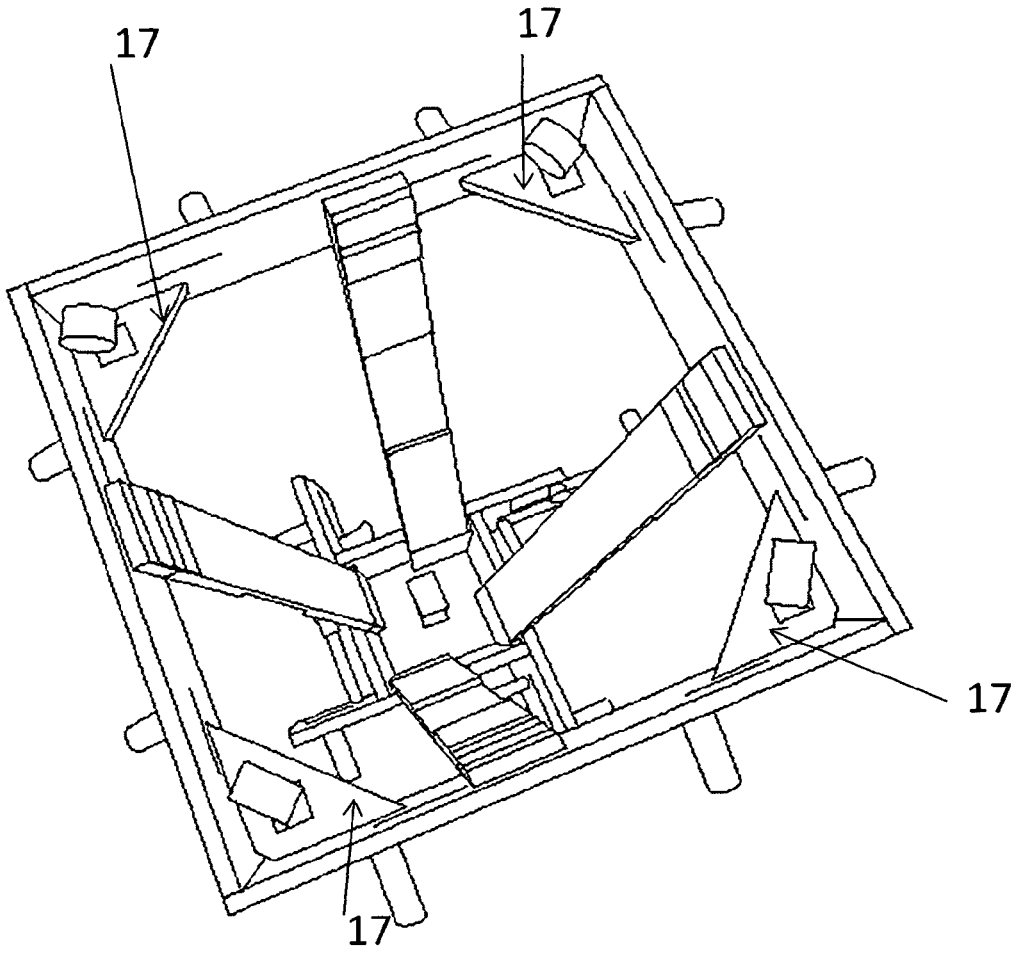
FIG. 9 shows the same corner blocks from below. Here they are also labeled 17.
Figure 10:
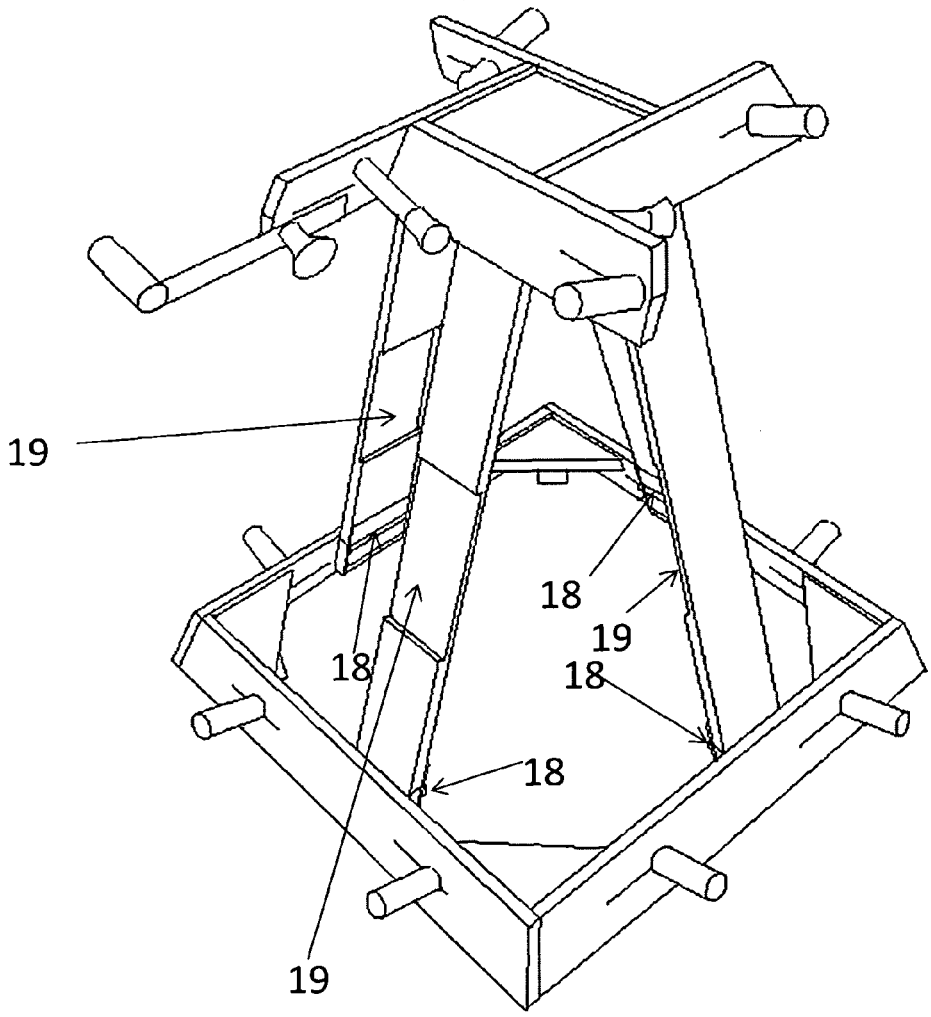
FIG. 10 shows the folding apparatus. First, the hinges at the bottom of the struts are indicated by the number 18. Second, the cutouts along the struts are indicated by the number 19. Note that the adjacent struts have cutouts on the opposite side of the struts. These cutouts allow the struts to fold making a flat surface. This surface is of help when using the rack as a dolly.
Figure 11:
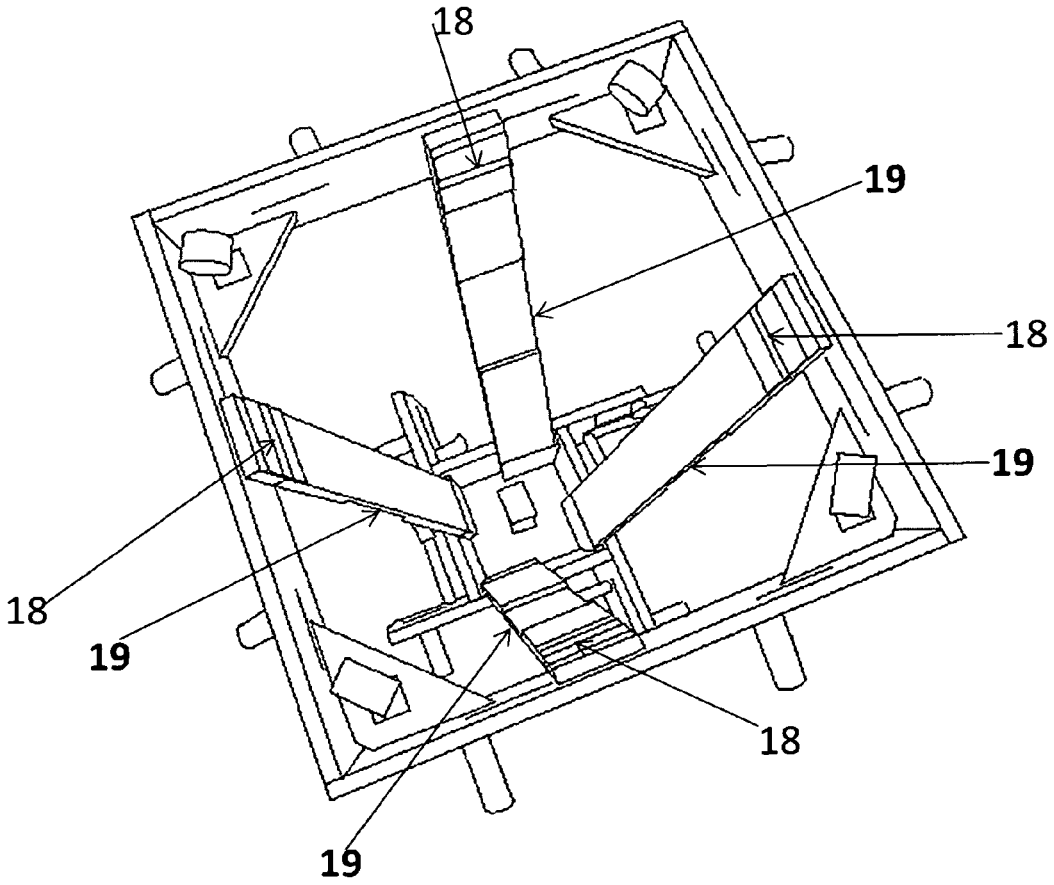
FIG. 11 shows the folding apparatus from below. First, the hinges, one for each strut, are indicated by the number 18. Second, the cutouts along the struts are indicated by the number 19.
Figure 12:
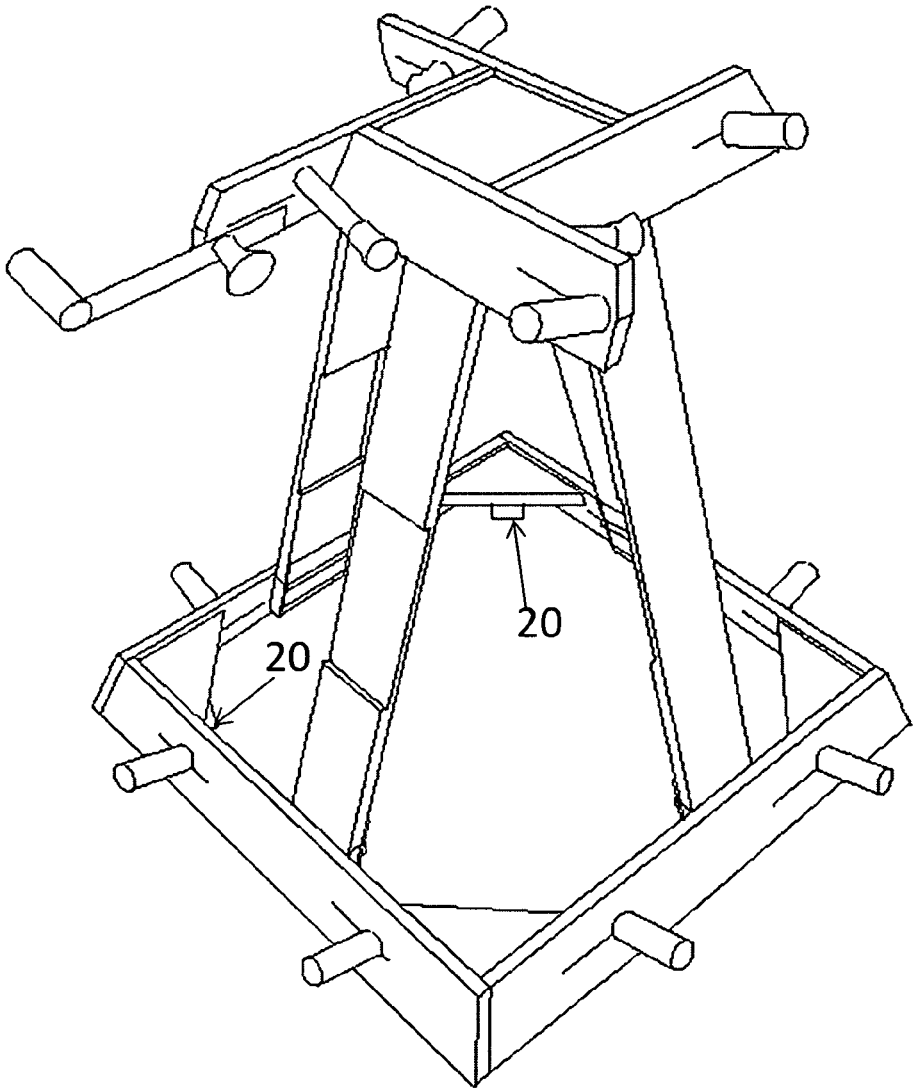
FIG. 12 shows how it is possible for the case rack to roll and spin. Under each of the corner blocks in the base, there is a caster. Two of these casters are partially visible in FIG. 12 and labeled 20. Of course, these casters can be removed or locked in order to make the case rack immobile.
Figure 13:
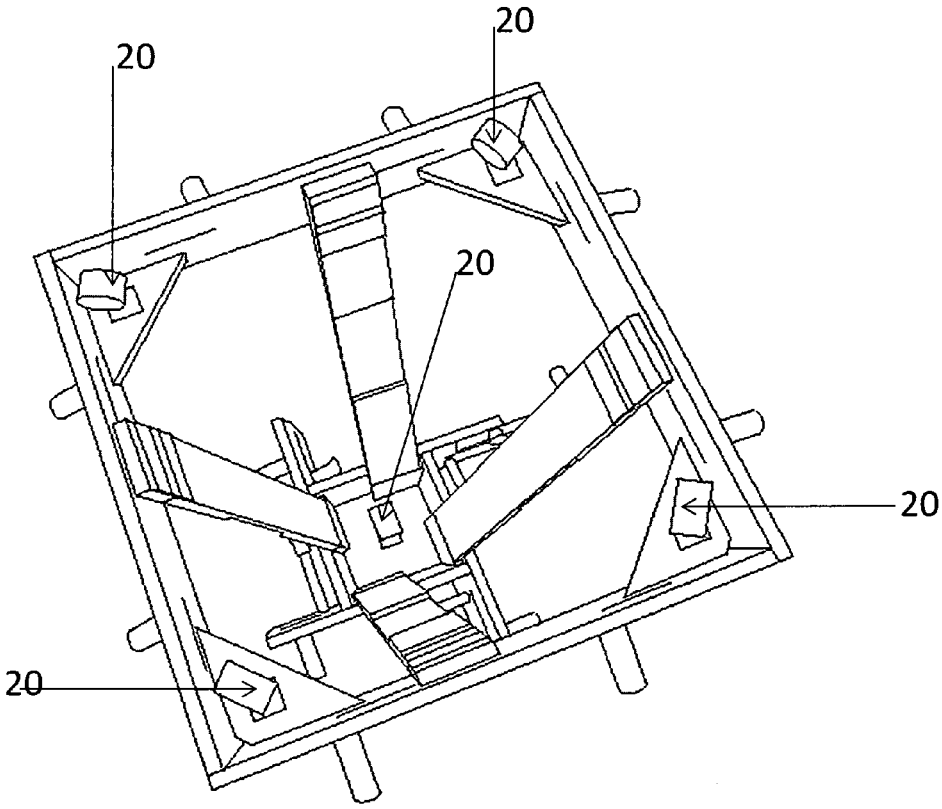
FIG. 13 shows the casters from below the case rack. There are four casters, one at each corner and mounted under the corner blocks, and one caster mounted under the cap top. Each of these 5 casters is labeled 20 in FIG. 13. The one caster mounted under the cap top comes into use only when the case rack is transformed into a dolly.
Figure 14:
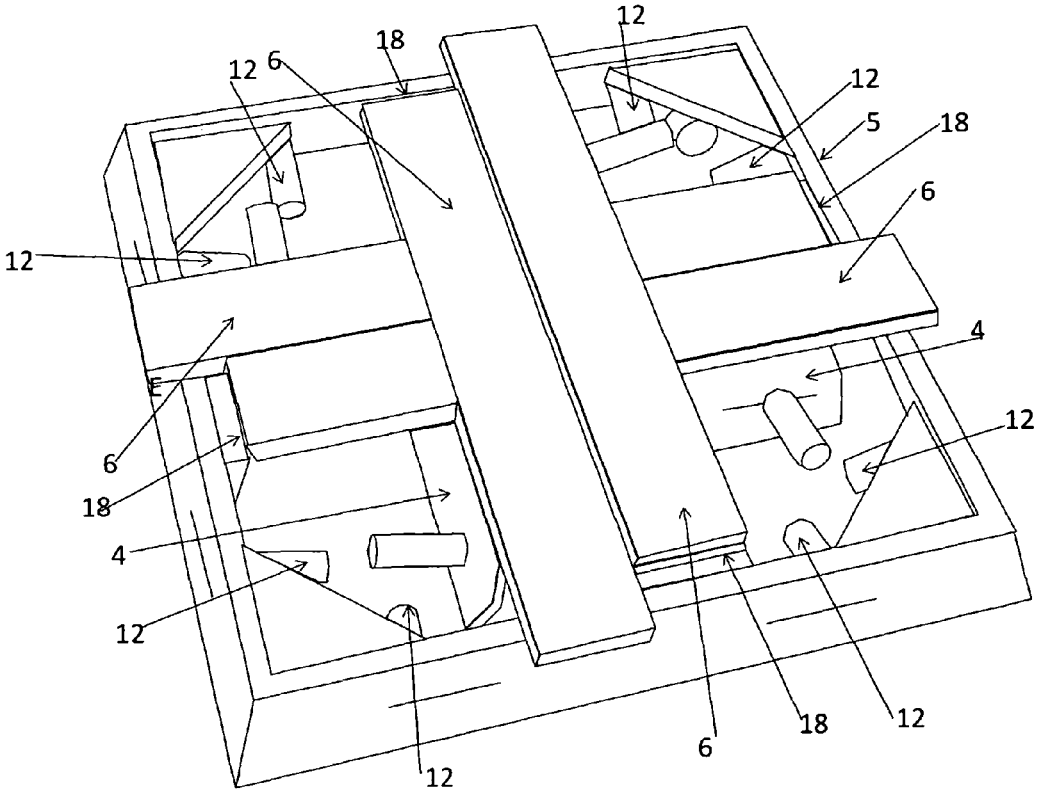
FIG. 14 shows the folded case rack transformed into a dolly. The basic parts are the base, 5, the struts, 6, and the cap, 4. The cap, 4, was removed and placed inside the base, 5. The struts fold by virtue of the hinges labeled 18. The supports around the outside of the base were removed, turned inward, and reattached. These supports are labeled 12. If doorways are sufficiently wide, it is not necessary to alter the position of the supports around the outside of the base. The supports on the cap were not affected by the transformation to a dolly.
Figure 15:
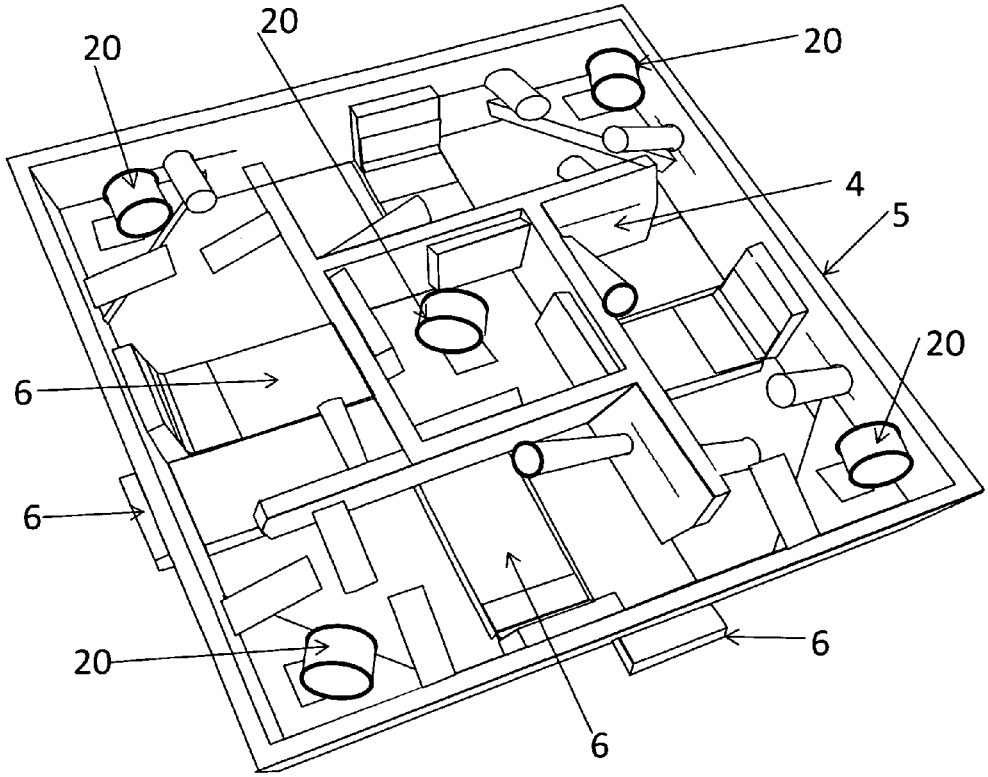
FIG. 15 shows the dolly configuration of the guitar case rack from below. The cap, 4, is seen nesting inside the base, 5. The struts, 6, are seen folded. The five casters, 20, are also shown.

This invention is a guitar case rack. It is not a guitar rack. It can accommodate the cases for a variety of instruments: guitars, bass guitars, banjos, banjitars and so on. It can also accommodate cases with various designs: ordinary hour-glass-shaped cases, rectangular cases, cases with convex backs, and cases with concave neck backs. The goal is to allow easy access to instruments while, at the same time, providing good security for instruments in their cases as well as compact storage for the cases.

One aspect of access to the instruments is facilitated by holding the cases tipped back and simultaneously rotated to the right. This combination allows the lids to be opened and to stay open and to keep guitars from falling out regardless of whether the cases have been left open. There are other guitar case racks that rely on rotating the cases to the right, but these racks require the cases to be removed from the rack and put elsewhere, a table or the floor, to open the lid and to get access to the instrument. The combination of tipping the case back and rotating it to the right allows the case to stay on the rack while the instruments are accessed.

Another aspect of access is facilitated by the case rack being mobile. Being able to spin the rack is especially important as it allows the instrumentalist to stay in one position and switch instruments quickly. This facilitates A-B comparisons of instruments in the studio and changing instruments in performance settings. The ability of the rack to roll allows a plurality of guitars to easily be moved in their cases from one part of a studio to another, from one studio to another, from the stage to backstage, or from backstage to a vehicle.

The downsides of being able to spin and roll are obvious. First, it creates a temptation for some people to use the case rack inappropriately, as a people mover. Of course, consumers must be warned against misuse of this product. Second, the case rack could move inadvertently because it is bumped or because it is placed on a floor that is not flat. The consequences of moving inadvertently are potentially serious: for example, a case rack could roll off a stage. However, the casters that allow the case rack to spin and roll can be of the locking type and thus can remove the most serious risks if the locks are used. Also, when immobility is desired, the casters can be removed.

Two distinct goals are achieved by making the case rack fold. First, the case rack itself can be stored compactly. Second, it can be used as a dolly. Suppose that a band is preparing to leave an event. First, the band or its crew rolls the rack filled with guitars in their cases to their vehicle. They remove the guitars in their cases from the rack for transit, fold the rack into its dolly configuration, and return to the stage to get other equipment such as amplifiers and drum kits. After getting this equipment to the vehicle, the rack is stored in the vehicle and off they go: people, guitars, other equipment, and the case rack. Obviously, this process is reversed when they arrive at the venue. In addition, the fact that the case rack folds facilitates shipping with no assembly required.

SUMMARY

This invention is for a guitar case rack that holds a plurality of guitar cases with the case lids open or closed. It spins, rolls, or stays in place at the desire of the user. It folds and still rolls transforming into a robust dolly. It can accommodate a wide variety of case designs.

The invention claimed is:

1. A guitar case rack having four sides capable of holding a plurality of guitar cases comprising:

(a) a base having four sides, four corners, and a corner block at each corner of the base, a caster attached to an underside of each corner block;

(b) a plurality of struts pivotally connected to the base; each strut of the plurality of struts extends upwards from a respective side of the base in a sloping manner;

(c) a rectangular cap having four sides removably mounted on top of the plurality of struts; the cap comprises a cap side extension on each side of the cap that extends beyond the respective side of the cap, the cap having an area smaller than the area of the base;

(d) a plurality of supports to support the guitar cases in a tilting manner, each of the plurality of supports is attached to and generally perpendicular to a respective cap side extension of said cap;

(e) an additional caster attached to an underside of the cap; wherein in a usage position, the base, the plurality of struts and the cap are arranged in a pyramidal form such that a guitar case can be mounted on each side of the rack and supported on the supports in a tipped back manner; and wherein in a storage position, the plurality of struts fold in four directions across a top of the base in a cruciform shape and the cap is attached underside the plurality of struts such that the casters on the base and the cap can be used to transform the rack into a dolly.

2. The guitar case rack of claim 1, further comprising horizontal slots in each side of the base; the base further comprising base supports perpendicularly attached to a respective side of the base; the base supports are adjustable and capable of sliding linearly in the respective horizontal slot.

3. The guitar case rack of claim 2, further comprising a wood screw fastened to a back side of each base support and a washer on said wood screw adapted to prevent said horizontal slot from being distorted by the screw.

4. The guitar case rack of claim 1, wherein said each cap side extension comprise a horizontal slot; said each support of the plurality of supports is adjustable and capable of sliding linearly in the horizontal slot of said cap side extension.

5. The guitar case rack of claim 4, further comprising a wood screw fastened to a back side of each support and a washer on said wood screw adapted to prevent said horizontal slot from being distorted by the screw.

6. The guitar case rack of claim 1, wherein said each of the plurality of struts comprise a cutout substantially in the middle of each strut to allow each strut to lay flat on an adjacent strut in the storage position and wherein the plurality of struts are mounted off center on the base such that the struts can lay flat on top of the base in the cruciform shape.

7. The guitar case rack of claim 1, further comprising an extension support extending generally parallel to one of the cap side extensions for supporting rectangular guitar cases.

* * * * *